US006581777B2

(12) United States Patent
Thibault

(10) Patent No.: US 6,581,777 B2
(45) Date of Patent: Jun. 24, 2003

(54) PRODUCT PACKAGING CREATING A VISUAL IMPRESSION OF A PACKAGED ITEM FLOATING WITHIN A FRAME AND METHODS FOR MAKING SAME

(75) Inventor: Richard C. Thibault, Bromall, PA (US)

(73) Assignee: Westvaco Packaging Group, Inc., New York, NY (US)

( * ) Notice: Subject to any disclaimer, the term of this patent is extended or adjusted under 35 U.S.C. 154(b) by 0 days.

(21) Appl. No.: 09/881,357

(22) Filed: Jun. 14, 2001

(65) Prior Publication Data

US 2003/0042171 A1 Mar. 6, 2003

(51) Int. Cl.[7] ..... B65D 25/54
(52) U.S. Cl. ..... 206/780; 206/779; 206/470
(58) Field of Search ..... 206/335, 461, 206/467, 470, 471, 779, 780

(56) References Cited

U.S. PATENT DOCUMENTS 2,993,587 A * 7/1961 Stone et al. ..... 206/471
3,481,453 A * 12/1969 Shreve, III et al. ..... 206/778
3,847,276 A * 11/1974 Lehner et al. ..... 206/782
4,848,577 A * 7/1989 Hoffman et al. ..... 206/467

* cited by examiner

*Primary Examiner*—David T. Fidei
(74) *Attorney, Agent, or Firm*—Priest & Goldstein, PLLC

(57) ABSTRACT

A cost-effective package is described that creates a visual impression of a packaged item floating within a frame. The package includes a chassis having a compartment for holding the item and a frame for holding the chassis. The chassis includes a front panel and a rear panel. The chassis compartment is formed by a cavity in the front panel and a corresponding cavity in the rear panel. The chassis further includes a flange for installing the chassis into the frame. The flange is formed by first and second flange flaps that extend respectively from the front and rear chassis panels. The frame for holding the chassis includes a series of panels that fit around the outer perimeter of the chassis. One of the panels includes a guide channel and slot for receiving the chassis flange. The package is formed by sliding the chassis into the frame and folding the frame closed around the chassis.

21 Claims, 13 Drawing Sheets

PRODUCT PACKAGING CREATING A VISUAL IMPRESSION OF A PACKAGED ITEM FLOATING WITHIN A FRAME AND METHODS FOR MAKING SAME

BACKGROUND OF THE INVENTION

1. Field of the Invention

The present invention relates generally to improvements to product packaging, and more particularly to advantageous aspects of product packaging creating a visual impression of a packaged item floating within a frame and methods for making same.

2. Description of the Prior Art

In today's competitive marketplace, the packaging used to hold and display a retail item may serve as an effective way to distinguish one manufacturer's product from another manufacturer's, particularly where the packaging has an unusually striking appearance. Thus, today's packaging industry is constantly striving to develop new types of packaging that create a unique and memorable visual impression in the eyes of potential purchasers. In addition to esthetic considerations, the packaging industry also strives to develop packaging that is cost-effective to manufacture.

SUMMARY OF THE INVENTION

The above-described issues and others are addressed by the present invention, one aspect of which provides a cost-effective package that creates a visual impression of a packaged item floating within a frame. The package comprises a chassis having a compartment for holding the item and a frame for holding the chassis. The chassis includes a front panel and a rear panel. The chassis compartment is formed by a cavity in the front panel and a corresponding cavity in the rear panel. The chassis further includes a flange for installing the chassis into the frame. The flange is formed by first and second flange flaps that extend respectively from the front and rear chassis panels. The frame for holding the chassis comprises a series of panels that fit around the outer perimeter of the chassis. One of the panels includes a guide channel and slot for receiving the chassis flange. The package is formed by sliding the chassis into the frame and folding the frame closed around the chassis.

Additional features and advantages of the present invention will become apparent by reference to the following detailed description and accompanying drawings.

DETAILED DESCRIPTION

Figure 1:
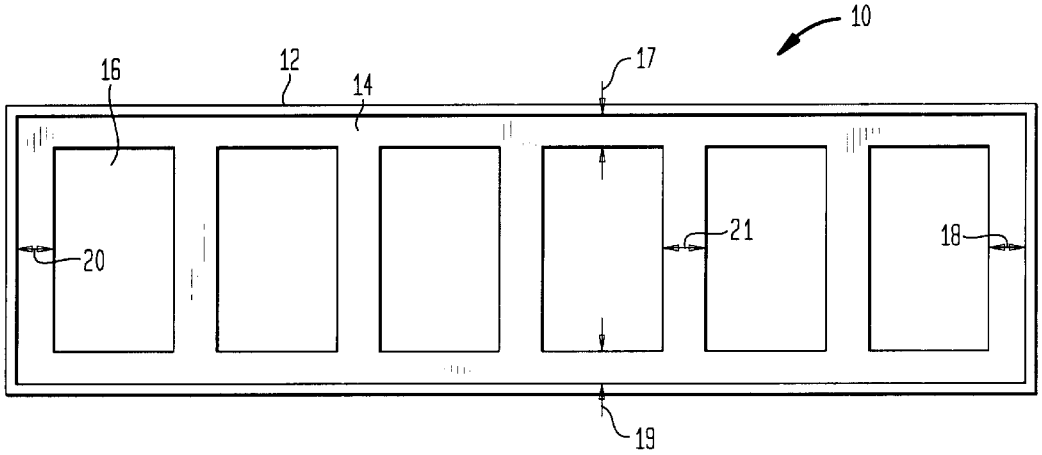
FIG. 1 shows an elevation view of a package according to a first aspect of the invention.
Figure 2:
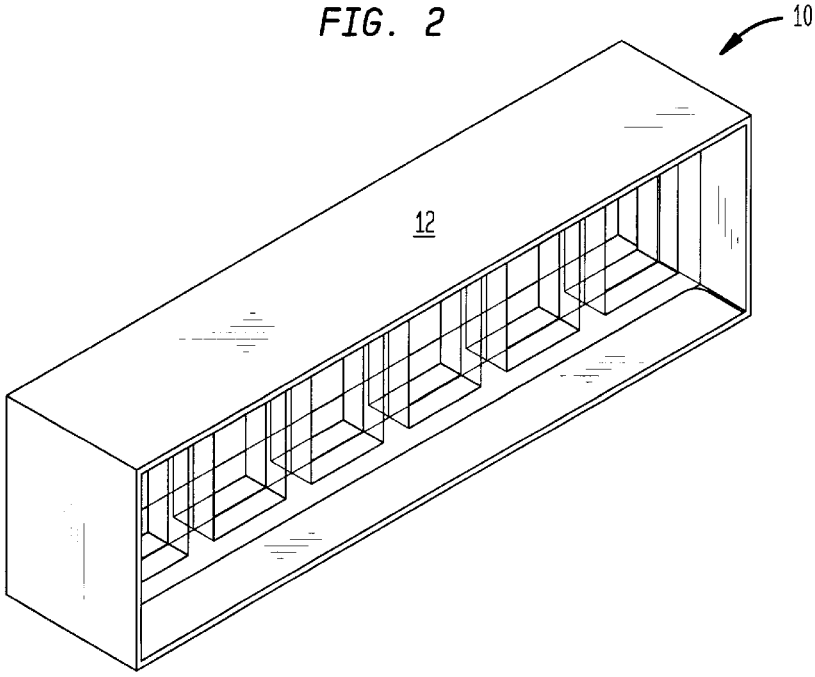
FIG. 2 shows a perspective view of the package shown in FIG. 1.
Figure 3:
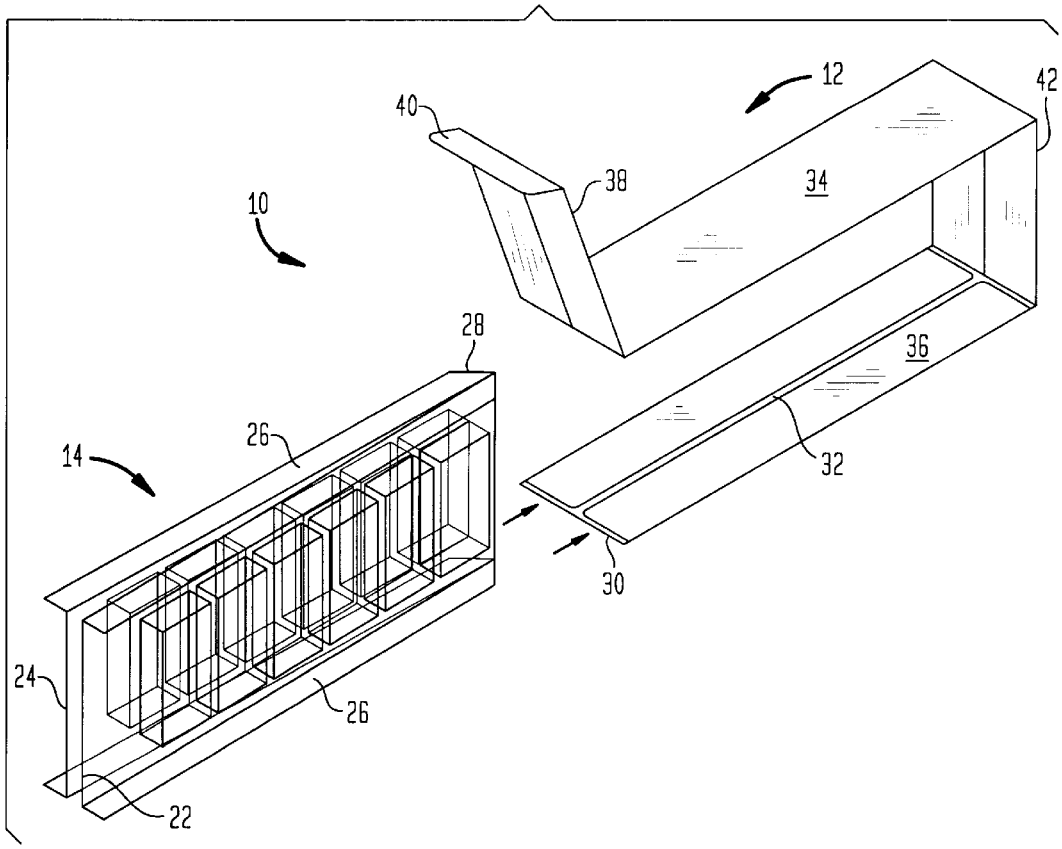
FIG. 3 shows a perspective view of a first assembly stage of the package shown in FIGS. 1 and 2.
Figure 4:
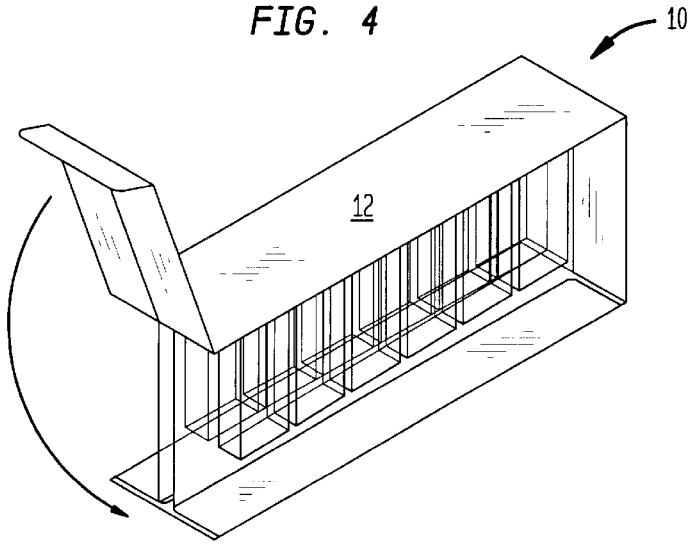
FIG. 4 shows a perspective view of a second assembly stage of the package shown in FIGS. 1 and 2.

A first aspect of the present invention provides a package for holding a retail product that creates a visual impression of the packaged item floating within a frame. FIGS. 1 and 2 show, respectively, front elevation and perspective views of a package 10 according to this aspect of the invention, and FIGS. 3 and 4 show perspective views of the package 10 in earlier stages of assembly. The package 10 includes a frame 12 and a chassis 14 that is held within the frame 12. The chassis 14 includes a series of compartments 16 that are shaped to hold the packaged item. According to the present aspect of the invention, the chassis 14, including the compartments 16, is fabricated from a suitable material, such as plastic. According to a further aspect of the invention, the chassis 14 provides spacing 17–21 between the compartments 16 and the frame 12, and between adjacent compartments 16. The material used to fabricate the chassis 14, and the spacing between the compartments 16 and the frame 12 and between adjacent compartments 16, can be chosen to create the visual impression that the products contained in the compartments 16 are floating within the frame 12. In order to achieve this visual impression, the material used to fabricate the chassis 16 may suitably be transparent or translucent. It should be noted that any number of compartments 16, including a single compartment, may be used without departing from the spirit of the invention. Similarly, the compartments 16 may be of any shape. In particular, the compartments 16 may be shaped to closely approximate the outer contours of a retail product. The use of compartments shaped in this way enhances the visual impression that the packaged products are floating within the frame 12. The frame 12 is fabricated from cardboard, plastic, or other suitable material.

FIGS. 3 and 4 illustrate the package 10 in earlier stages of assembly. As shown in FIG. 3, the chassis 14 and frame 12 are separate units that are assembled together into a finished package by sliding the chassis 14 into the frame 12. As shown in FIG. 3, the chassis 12 includes a front panel 22 and a rear panel 24 that abut each other. Each compartment 14 is formed from a portion of the front panel 22 and a corresponding portion of the rear panel 24. In the package 10 shown in FIGS. 1–4, each compartment is formed by a cavity molded into the front panel 22 and a corresponding cavity molded in the rear panel 24.

Along the top and bottom edges of the chassis 14 are disposed flanges 26 that are used to hold the chassis 14 in the frame 12. Each flange 26 includes a front portion extending from the front panel 22 and a rear portion extending from the rear panel 24. The lead end of each flange 26 is tapered to form a pointed wedge 28 that facilitates the sliding of the chassis 20 into the frame 12.

As shown in FIG. 3, the frame 12 includes a series of panels 34, 36, 38 and 42 that are dimensioned such that the frame 12 fits closely around the chassis 14 in the finished package 10. The frame 12 includes upper and lower guide channels 30 that run the length of the upper and lower panels 34 and 36 of the frame 12. The guide channels 30 include slots 32 facing the interior of the frame 12. The guide channels 30 and slots 32 are dimensioned and positioned to receive the flanges 26 and chassis panels 22 and 24 as the chassis 14 is slid into position within the frame 12. The frame 12 further includes a side panel 38 with a tuck 40. The side panel 38 is folded out of the way to allow the chassis 20 to be inserted into the frame 12. After the chassis 20 has been inserted into the frame 12, the side panel 38 is folded over to close the frame. The tuck 40 is tucked into the channel 30 and is held in place by friction in the finished package. If desired, a locking arrangement can be provided to prevent the tuck 40 from being accidentally pulled out of the channel 30. Another side panel 42 defines the end of the guide channel 30.

The package 10 illustrated in FIG. 3 has a rectangular frame. Thus, the upper and lower panels 32 and 34 have substantially the same size and shape. Similarly, the side panels 38 and 42 also have substantially the same size and shape. However, it will be apparent that the shape of the package 10, and the shape and size of the panels 32, 34, 38, and 42 may be modified without departing from the spirit of the invention.

Figure 5:
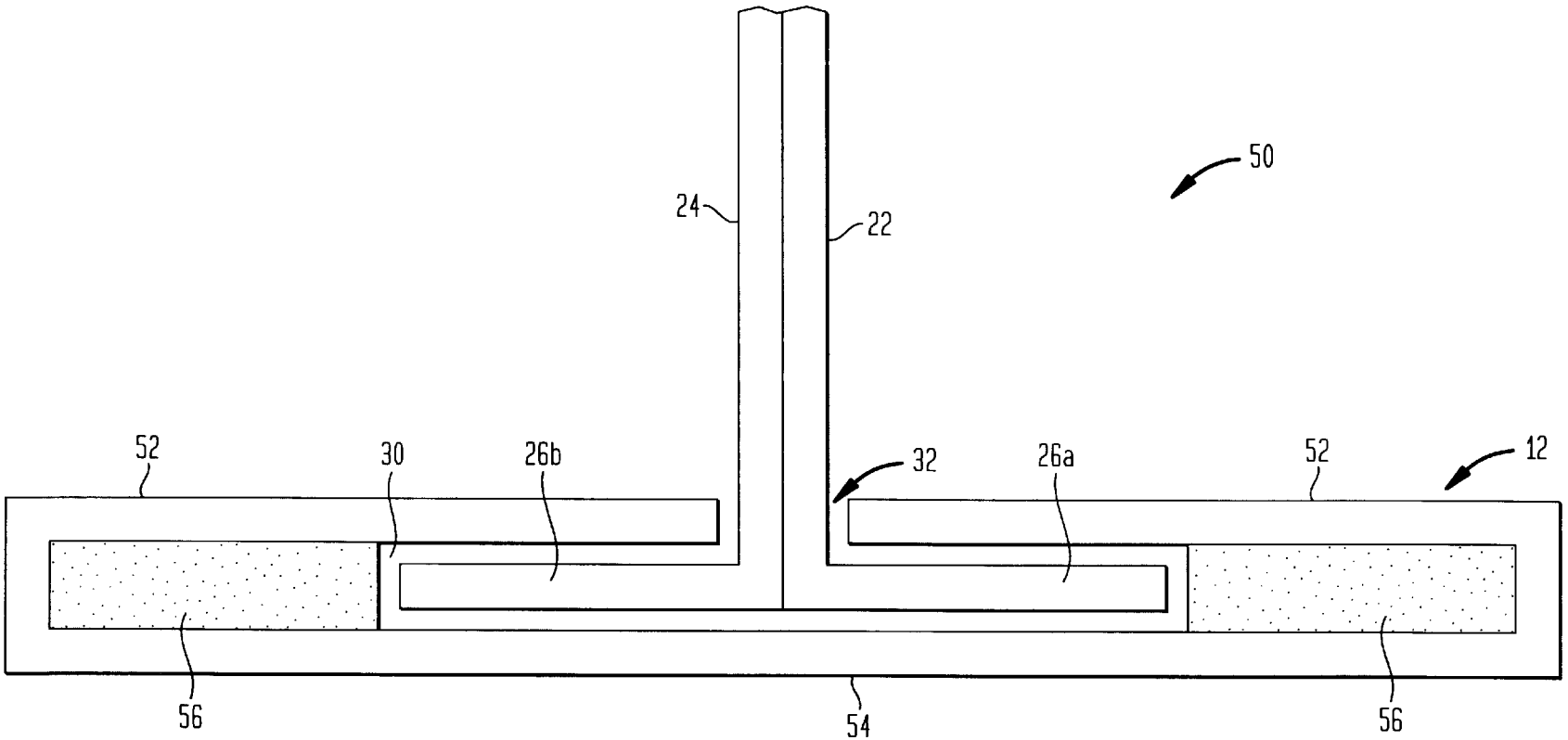
FIG. 5 shows a cross section diagram of the flange and guide channel arrangement used in the package shown in FIGS. 1 and 2.

FIG. 5 is a partial cross sectional diagram illustrating the flange and guide channel arrangement 50 in greater detail. As shown in FIG. 5, each channel 50 is formed by folding a pair of channel flaps 52 over an outer panel 54 of the frame 12. The outer portion of each flap is attached to the outer frame panel 54 by glue 56. As shown in FIG. 5, the glue 56 is applied only to an outer region of the frame 12. Thus, each channel 30 is defined by the inner surface of the outer frame panel 54, the inner surface of the flaps 54, and by the inner surface of the glue 56. FIG. 5 also illustrates that each flange includes a front portion 26*a* formed as part of the front panel 22 and a rear portion 26*b* formed as part of the rear panel 24. As further shown in FIG. 5, the guide slot 32 is formed by the gap between the ends of the pair of channel flaps 52.

According to a further aspect of the invention, the chassis 14 shown in FIGS. 1 through 5 is formed from a single sheet of plastic that has been vacuum-formed, cut, folded, and then loaded into the frame 12. According to this aspect of the invention, the frame 12 is formed from a single sheet of cardboard or other suitable material that has been cut, folded, and then glued.

Figure 6:
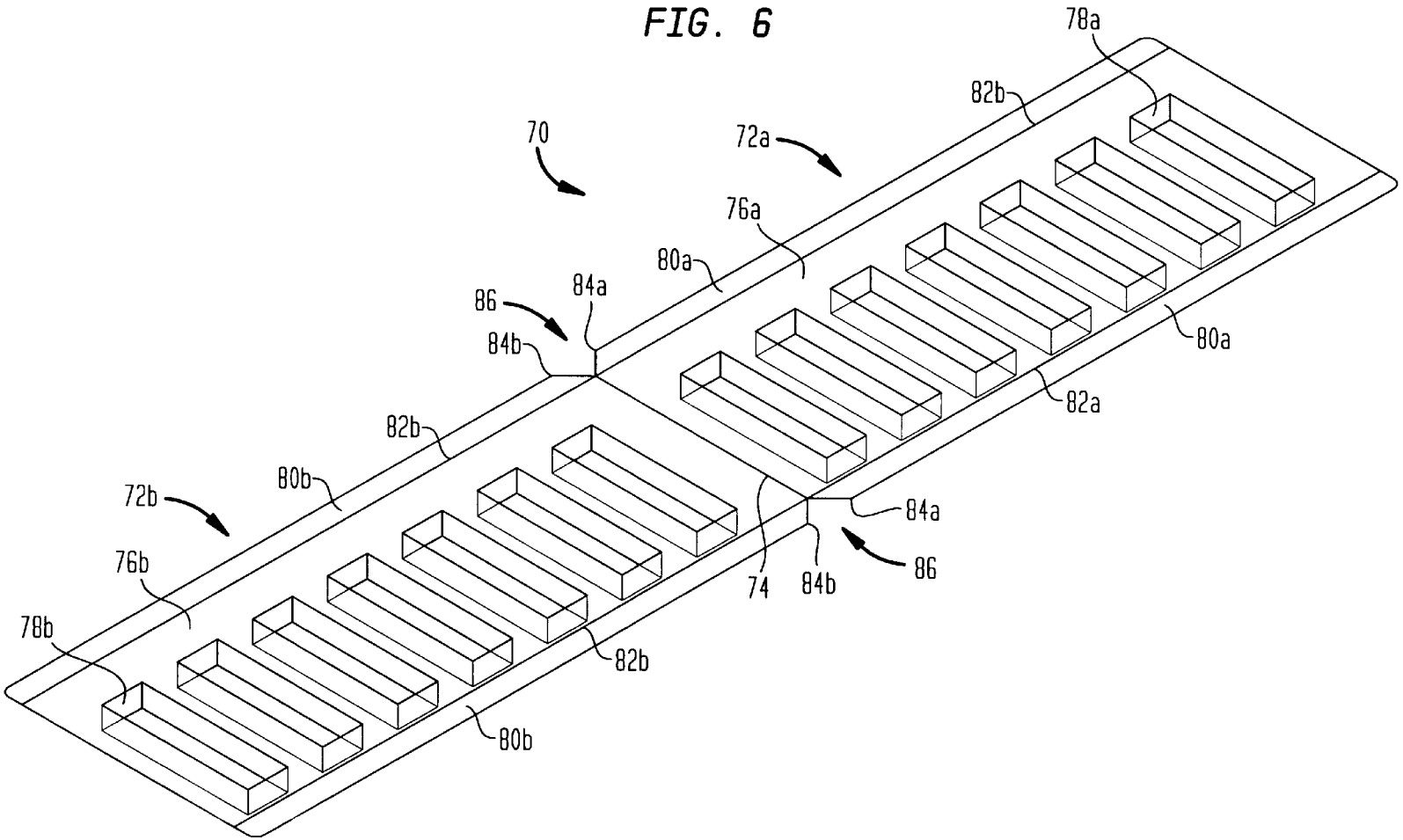
FIG. 6 shows a perspective view of a chassis for use in constructing a package according to an aspect of the present invention.

FIG. 6 shows a perspective view of a chassis 70 according to one aspect of the invention. The chassis 70 is similar to the one used to construct the package 10 shown in FIGS. 1 through 5. However, the number of compartments and their shape are different.

As shown in FIG. 6, the chassis 70 includes a front panel 72*a* and a rear panel 72*b* that are separated by a central score line 74. Each panel 72*a* and 72*b* includes a flat base portion 76*a* and 76*b* into which are formed a series of cavities 78*a* and 78*b*. Each panel 72*a* and 72*b* further includes flange flaps 80*a* and 80*b* along either side, which are separated from the flat base portions 76*a* and 76*b* by flange score lines 82*a* and 82*b*. As described further below, the flange score lines 82*a* and 82*b* include sections that are cut all the way through the plastic, sections that are scored, and sections that are neither cut nor scored. The use of these three types of sections allows the flange flaps 80*a* and 80*b* to be easily and cleanly folded into position. Each flange flap 80*a* and 80*b* includes a lead portion 84*a* and 84*b* that is tapered towards the central score line 74. These tapered lead portions 84*a* and 84*b* create a V-shaped notch 86 on either side of the central score line 74. The tapered portions 84*a* and 84*b* are used to form a pointed wedge which, as described above, facilitates the installing of the chassis 70 into the frame.

According to the present aspect of the invention, the chassis 70 is formed from a single sheet of plastic. One suitable plastic is 25-gauge PVC, although other plastics may also be used. The choice of material is governed by a number of considerations. One consideration is that it is desirable for the plastic to be sufficiently sturdy that the chassis 70 does not bow or otherwise lose its shape in the finished package. However, it is also desirable that the plastic is sufficiently light such that the chassis 70 does not cause any seams or other marks, bumps, or indentations to form on any of the exterior surfaces of the frame in the finished package.

One suitable technique for forming the cavities 78*a* and 78*b* in the sheet of plastic material is to use a vacuum forming technique. Using this technique, the sheet of plastic is placed over a die into which have been formed molding cavities having an interior surface corresponding in shape to the desired outer surface of the cavities in the finished chassis 70. Each molding cavity includes a number of small holes through which air may be evacuated. The sheet of plastic is held in position over the die, and then heated to a temperature at which the plastic becomes malleable. The air in the molding cavities is then evacuated through the small hole, creating a partial vacuum that pulls portions of the plastic sheet against the interior surfaces of the molding cavities. The molded plastic is allowed to set, and the sheet of plastic, with formed cavities, is then trimmed to form the outer perimeters of the front and rear panels 72*a* and 72*b*.

The central score line 74 and flange score lines 82*a* and 82*b* are die cut into the plastic as part of the trimming operation. It should be noted that other techniques, such as techniques using radio frequencies (RF) may also be used to fabricate the score lines. One consideration in choosing a scoring technique is the esthetic appearance of the finished package. A scoring technique that results in a jagged or uneven edge at the score line in the finished package is less desirable than a scoring technique resulting in a clean line in the finished package.

Figure 7A:
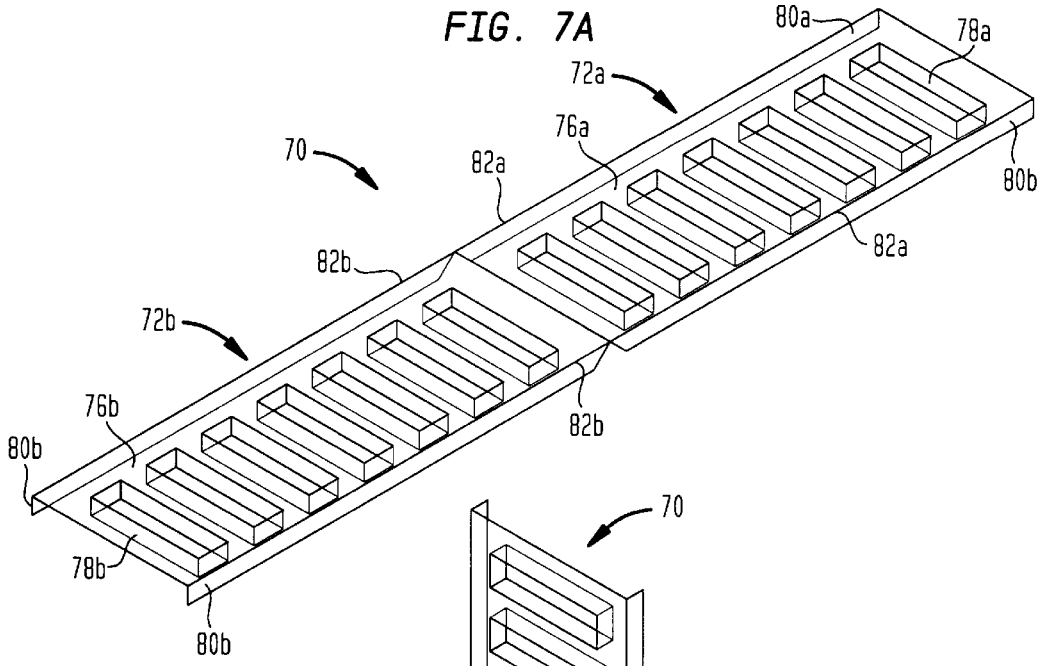
FIGS. 7A, 7B and 7C show perspective views of the chassis shown in FIG. 6 in various stages of assembly.
Figure 7B:
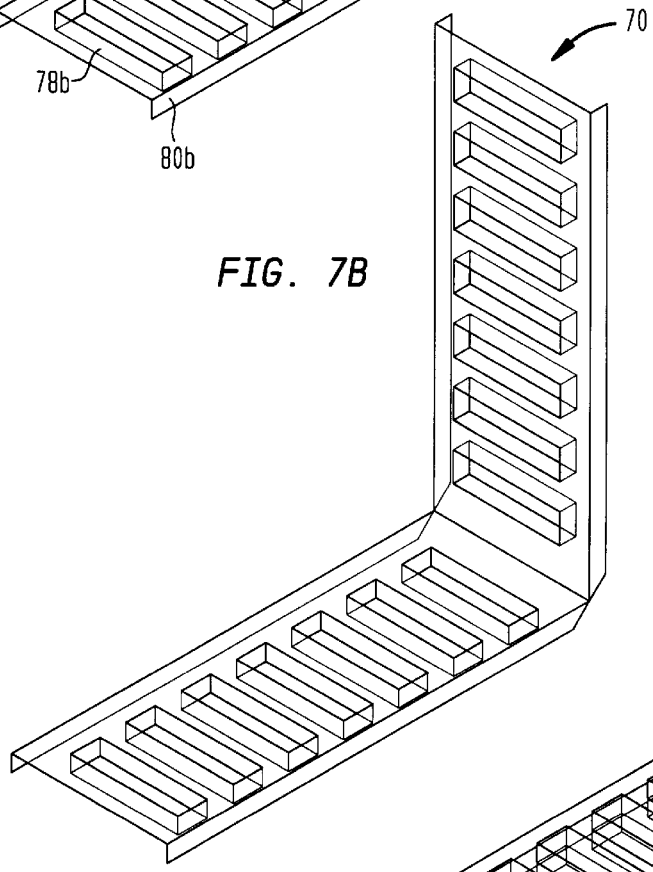
Figure 7C:
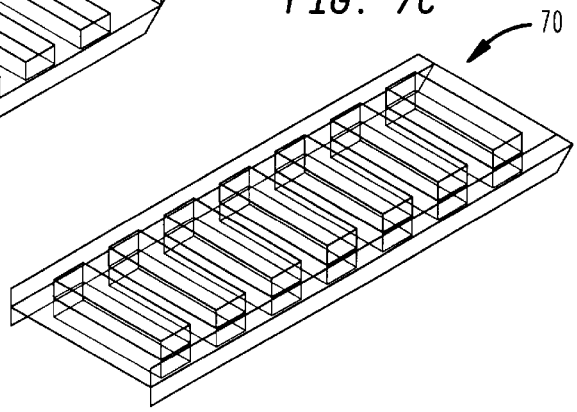

FIGS. 7A through 7C are perspective views of the chassis 70 shown in FIG. 6, illustrating the folding of the chassis 70 that is performed prior to the assembly of the package interior 70 into its supporting frame. As shown in FIG. 7A, the flange flaps 80*a* and 80*b* on either side of the front and rear panels 72*a* and 72*b* are first folded in the direction of the cavities 78*a* and 78*b* along the flap score lines. As shown in FIG. 7B, the front and rear panels 72*a* and 72*b* are then folded towards each other along the central score line 74. As shown in FIG. 7C, when this folding operation is completed, the flat base portions 76*a* and 76*b* of the two panels 72*a* and 72*b* abut each other.

As further shown in FIG. 7C, the front and rear panels 72*a* and 72*b* are shaped such that when they are folded towards each other along the central score line 74, the flat base portions 76*a* and 76*b* abut each other, and the outer perimeters of the front and rear panels 72*a* and 72*b* line up with each other. In addition, the cavities 78*a* and 78*b* on the front and rear panels 78*a* and 78*b* are positioned such that, in the finished package, the cavities 78*a* on the front panel 72*a* line up with corresponding cavities 78*b* on the rear panel 72*b* to form individual compartments for holding the items to be packaged.

It should be noted that corresponding pairs of cavities may have different shapes. For example, if the present invention is used to provide a package for a retail item having a front with a different shape from its rear, the cavity in the front panel corresponding to the front of the retail item will have a different shape from the cavity in the rear panel corresponding to the rear of the retail item. It should further be noted that it would also be possible to design a package according to the present invention in which a cavity on one panel does not have a corresponding cavity on the other panel. In this case, the compartment would be formed by a cavity molded into one of the panels and by the corresponding portion of the flat base of the other panel.

As further shown in FIG. 7C, when the first and second panels 72*a* and 72*b* are folded into position, flaps 78*a* and 78*b* form a flange on either side of the package interior 20. As described below, this flange is used to hold the chassis 70 in position within the frame. In FIG. 7C, the flange is shown to be substantially perpendicular to the flat base portions 76*a* and 76*b* of the front and rear panels 72*a* and 72*b*. It should be noted, however, that the angle of the flange relative to the flat base portions of the first and second panels may be altered without departing from the spirit of the invention. It should also be noted that when the flaps are initially folded into position, they may not be exactly perpendicular to the bases of the first and second panels because, for example, of the memory of the plastic material which may tend to pull the flaps into an oblique angle relative to the bases. However, once the flange score lines 82*a* and 82*b* have been creased, the flange score lines 82*a* and 82*b* act as hinges, allowing relatively free movement of the flange flaps 80*a* and 80*b* relative to the bases 76*a* and 76*b*. Thus, as described below, when the chassis 70 is slid into position inside the outer frame, the flange flaps 80*a* and 80*b* are held in the desired final position by the frame.

As further shown in FIG. 7C, when the chassis 70 is folded such that the front and rear panels 72*a* and 72*b* abut each other, the tapered portions 84*a* and 84*b* of the flange flaps 80*a* and 80*b* form pointed wedges at the lead end of the flanges formed by flange flaps 80*a* and 80*b*. As described above, these wedges facilitate the assembly of the chassis 70 into the frame.

Figure 8:
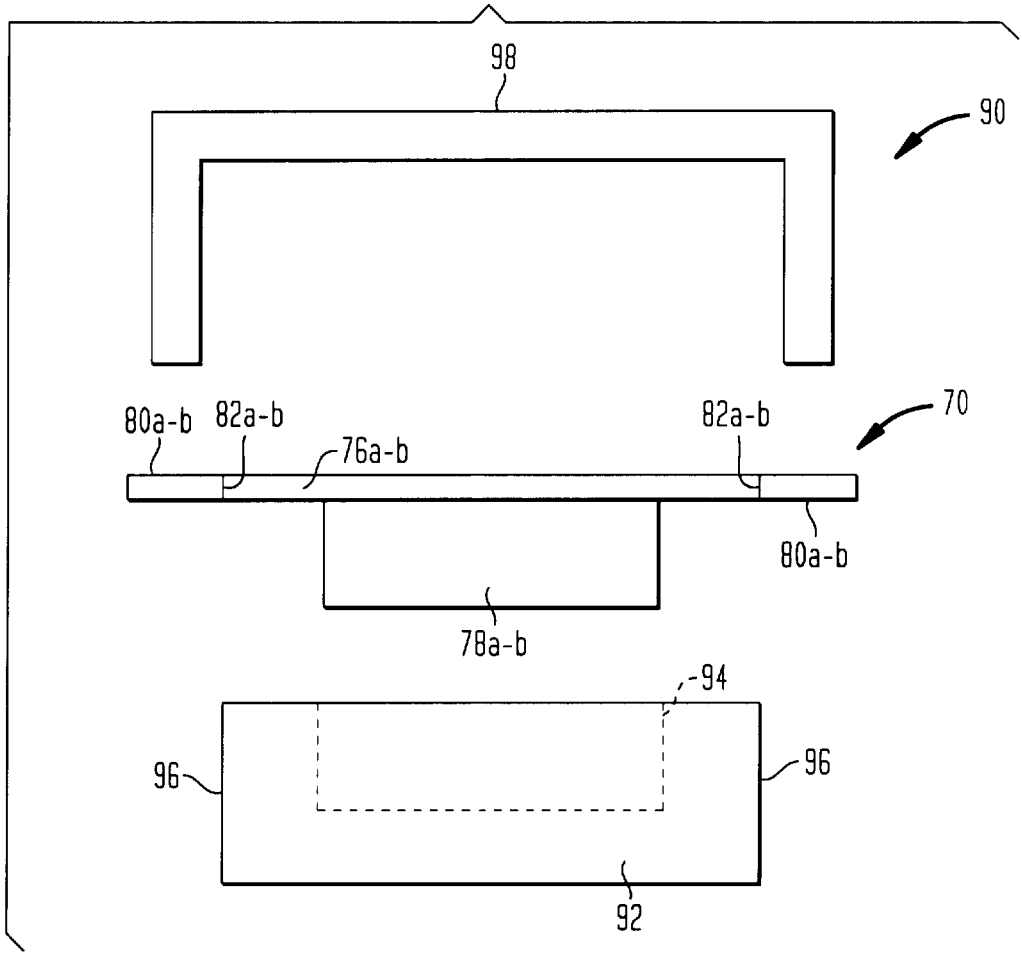
FIG. 8 shows an elevation view of a folding device for folding the flange flaps of the chassis shown in FIG. 6.
Figure 9:
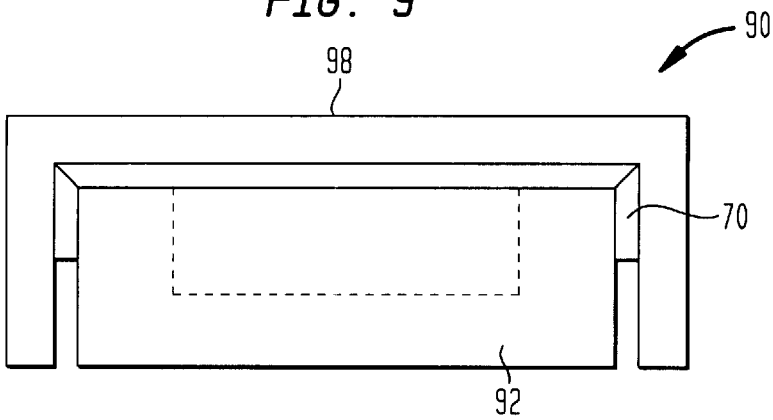
FIG. 9 shows an elevation view the folding device shown in FIG. 8 with the cover pressed down over a chassis held in the block of the folding device.
Figure 10:
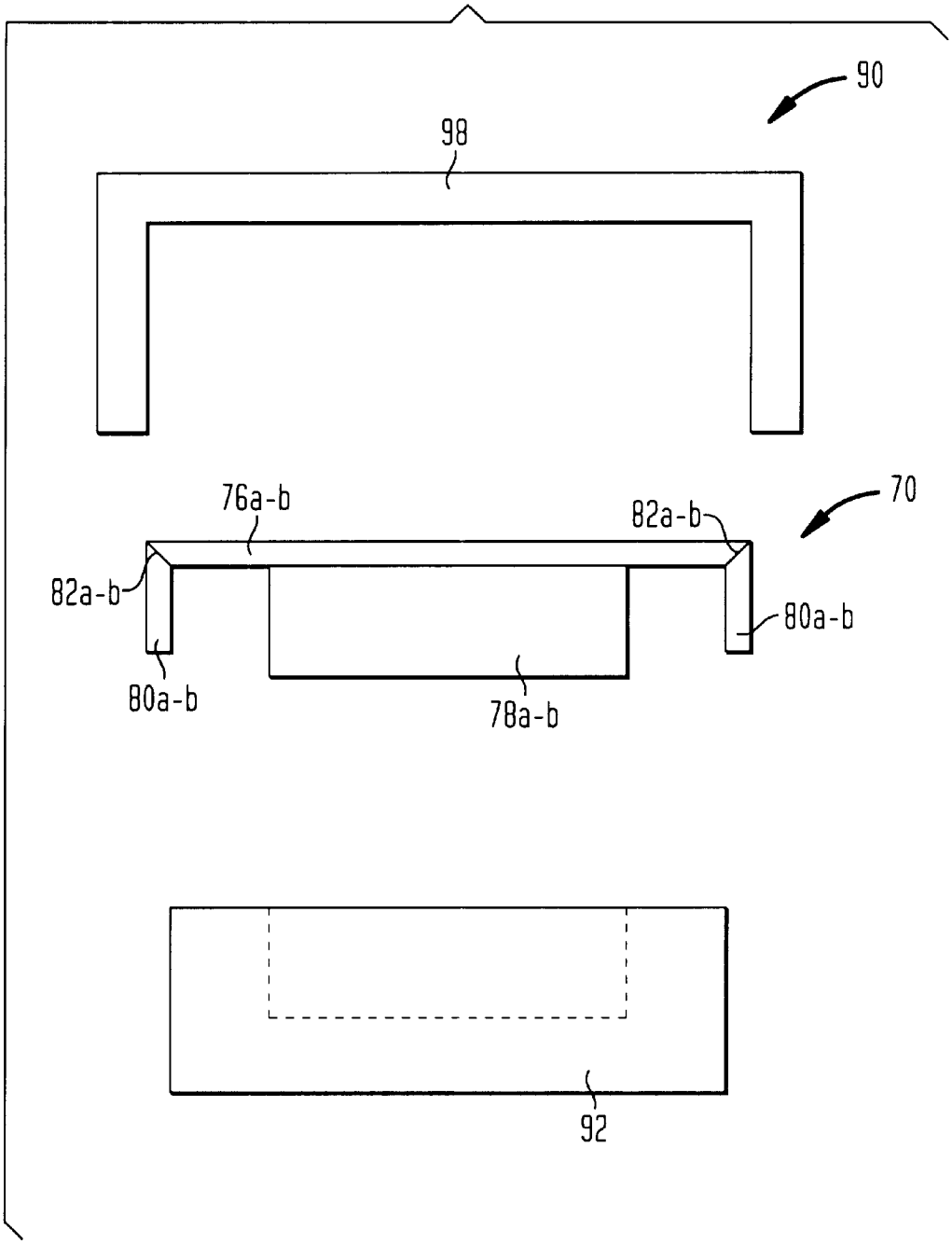
FIG. 10 shows an exploded view of the folding device shown in FIGS. 8 and 9 after the folding operation has been completed.

FIG. 8 shows an elevation view of a folding device 90, which can be used to fold the flange flaps 80*a* and 80*b* of the chassis 70 to make the folds shown in FIG. 7A. The folding device 90 includes a block 92 that is shaped to receive the unfolded chassis 70. The block 92 includes cavities 94 that are shaped and positioned to closely receive the cavities 78*a* and 78*b* of the chassis 70. The chassis 70 is placed onto the block 92 with the cavities 78*a* and 78*b* of the chassis 70 seated within the block cavities 94. As shown in FIG. 8, this arrangement causes the flange score lines 82*a* and 82*b* to line up with the outside edges 96 of the block 92. The outside edges 96 of the block 92 act as folding surfaces. The folding device 90 further includes a cover 98 that fits closely around the folding block 92. Thus, when the cover 98 is urged downward over a chassis 70 that has been seated onto the folding block 92, this causes the flange flaps 80*a* and 80*b* to be creased along the flange score lines 82*a* and 82*b*. The folding of the flange flaps 80*a* and 80*b* is illustrated in FIG. 9, which shows cover 98 urged down all the way over the chassis 70. The cover 98 can be hinged to the folding block 92 to facilitate the folding operation. FIG. 10 shows an exploded view of the folding device 90, illustrating the appearance of the chassis 70 after the flange flaps 80*a* and 80*b* have been folded into position.

Figure 11:
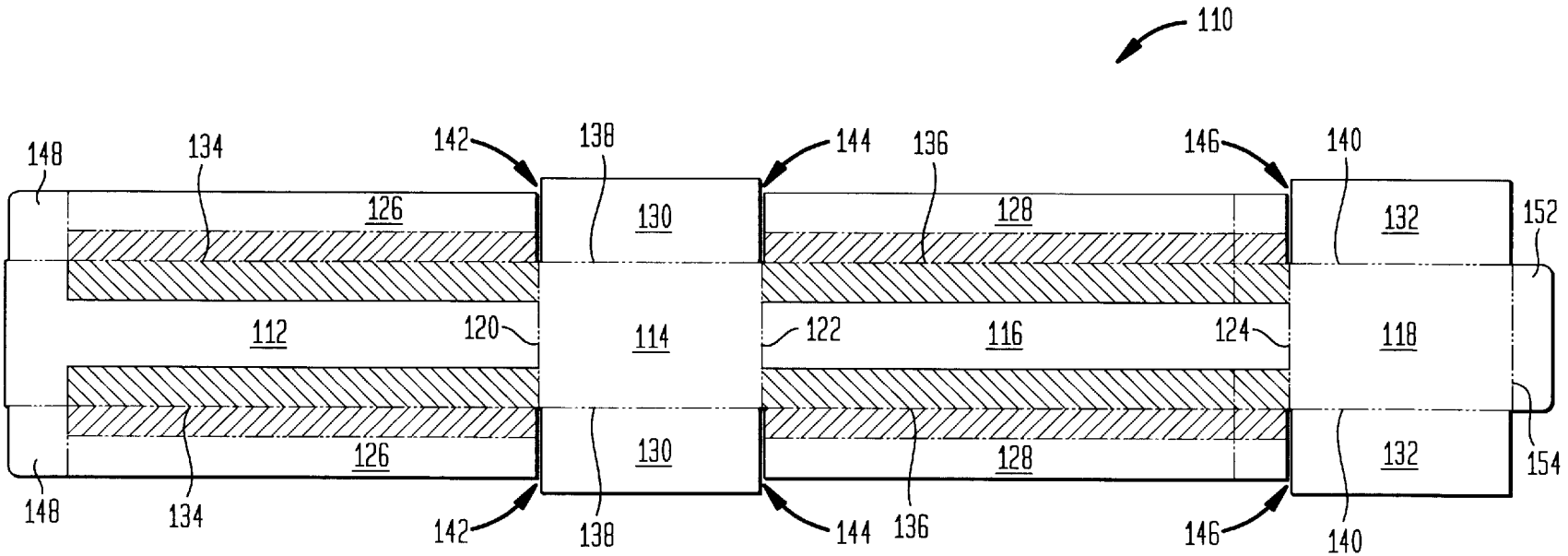
FIG. 11 shows a plan view of an unfolded frame that can be used with the chassis shown in FIG. 6 to fabricate a package according to the present invention.

As mentioned above, according to the present aspect of the invention, the frame is fabricated from a single sheet of cardboard or other suitable material. FIG. 11 shows a plan view of a frame 110 in its unfolded form. The frame includes a series of panels: a first panel 112, a second panel 114, a third panel 116, and a fourth panel 118. The four panels 112–118 form the four sides of a rectangular frame in the finished package. The first and third panels 112 and 116, and the second and fourth panels 114 and 118, form complementary pairs of panels on opposite sides of the finished carton. Thus, in the present aspect of the invention, the first and third panels 112 and 116, and the second and fourth panels 114 and 118, are of substantially the same size and shape. However, it would also be possible to construct a package having other than a rectangular shape, in which case the relative size and shapes of complementary pairs of panels may not be substantially the same. For example, it would be possible to design a frame that is trapezoidal in shape by making the third panel 118 longer than the first panel 112, and by changing the shape of the chassis 70.

The first panel 112 is separated from the second panel 114 by a first score line 120, the second panel 114 is separated from the third panel 116 by a second score line 122, and the third panel 116 is separated from the fourth panel 118 by a third score line 124. As shown in FIG. 11, the sheet of cardboard includes a number of flaps extending from either side of each panel. These flaps are used to form the guide channel and slot in the first panel 112 and third panel 116, and to provide support to the second panel 114 and fourth panel 118.

Specifically, the first panel 112 includes a first pair of channel flaps 126 extending from either side, and the third panel includes a second pair of channel flaps 128 extending from either side. The second panel 114 includes a first pair of support flaps 130 extending from either side, and the fourth panel includes a second pair of support flaps 132 extending from either side. The first pair of channel flaps 126 is separated from the first panel 112 by a first pair of channel flap score lines 134, and the second pair of channel flaps 128 is separated from the third panel 116 by a second pair of channel flap score lines 136. The first pair of support flaps 130 is separated from the second panel 114 by a first pair of support flap score lines 138, and the second pair of support flaps 132 is separated from the fourth panel 118 by a second pair of support flap score lines 140.

As shown in FIG. 11, the first pair of channel flaps 126 is separated from the first pair of support flaps 130 by a first pair of slots 142, the first pair of support flaps 130 is separated from the second pair of channel flaps 128 by a second pair of slots 144, and the second pair of channel flaps 128 is separated from the second pair of support flaps 132 by a third pair of slots 146. As shown below, the third pair of slots 146 forms one of the lead ends of the guide channels in the finished package. The first and second pairs of slots 142 and 144 are provided to facilitate a clean fold along the first and second score lines 120 and 122.

The guide channels for the chassis 70 are formed by folding the channel flaps 126 and 128 over their respective panels 112 and 116. The channel flaps 126 and 128 have widths that are chosen such that when the channel flaps are folded over their respective panels, a gap remains between them. This gap forms a guide slot for the chassis. In order to create guide channels of the desired width, glue is applied only to a portion of the channel flaps and first and third panels as illustrated in FIG. 5, discussed above. In FIG. 11, the portion of the channel flaps and first and third panels onto which glue is applied is shown as a shaded region. The unglued portion of the channel flaps and the first and third panels form the guide channels in the finished package. In addition, the first panel 112 includes an unglued region 148 at one end. The unglued region 148 receives a tuck 152, which is used to close the finished frame. In addition, the unglued region facilitates the insertion of the chassis 70 into the frame. The tuck 152 extends from an edge of the fourth panel 118, and is separated therefrom by a tuck score line 154. The tuck 152 is held in place in the finished package by friction. If desired, a locking arrangement may be added to prevent the tuck 152 from accidentally being pulled out of the guide channel.

Support flaps 130 and 132 provide support to the second and fourth panels 114 and 118. As shown in FIG. 11, support flaps 130 and 132 are dimensioned such that they overlap when the support flaps are folded down over the second and fourth panels. The overlap provides reinforcement of the second and fourth panels at the edges of the chassis 70 in the finished package. This reinforcement is useful to prevent the edges of the chassis from causing an unsightly seam or other blemish to appear at the outside of the frame in the finished package. After the support flaps are folded into place, they are held in position by glue. Because the guide channels do not extend into either the second or fourth panels, the glue may be freely applied as needed to hold the support flaps in place.

According to a further aspect of the present invention, the frame 110 is cut out of a sheet of cardboard or other material in a die cutting operation. In addition to cutting blades, the die used to cut the blank also includes scoring blades that press the score lines into the blank.

Figure 12:
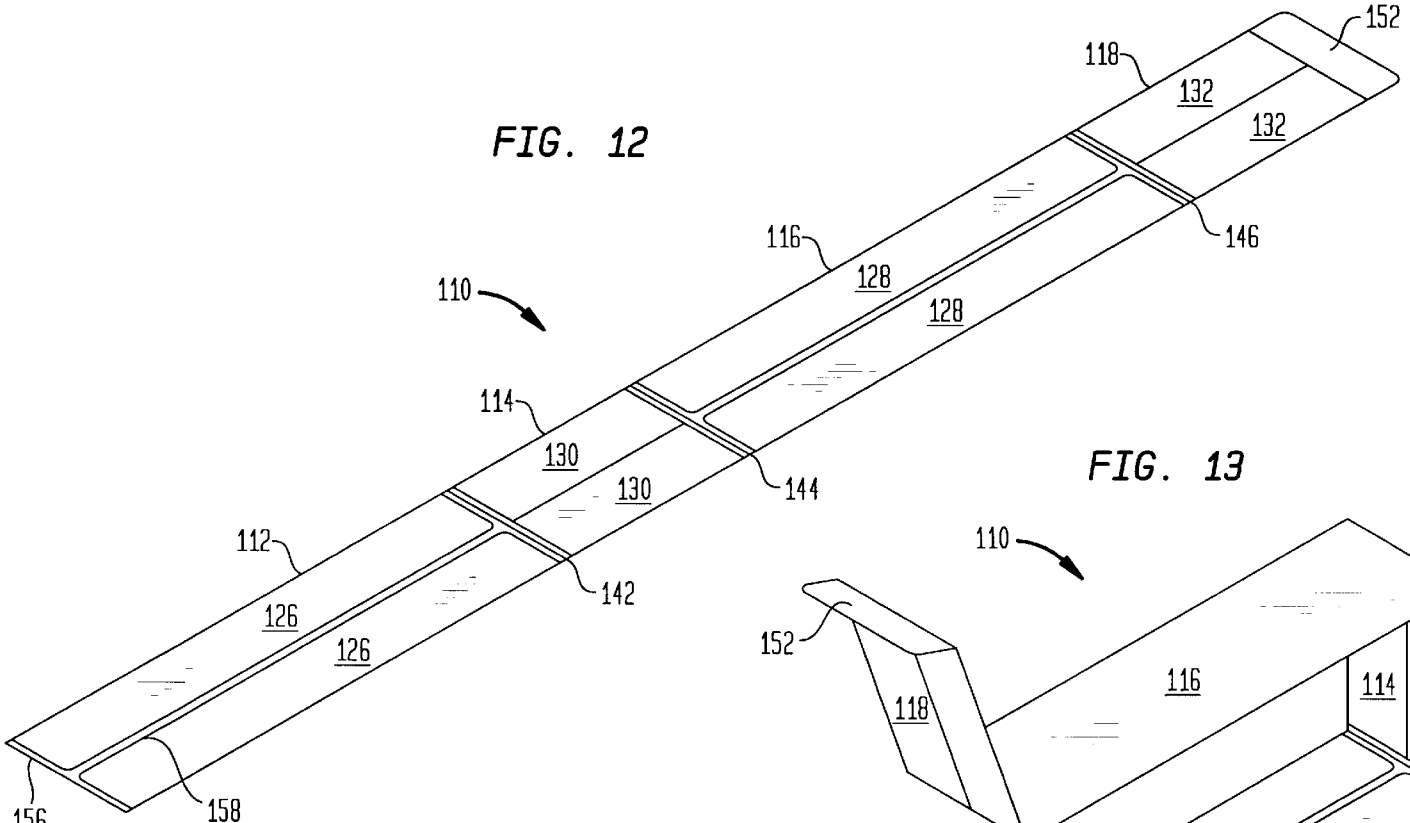
FIG. 12 shows a perspective view of the frame shown in FIG. 11 with the channel flaps and support flaps folded into position.

FIG. 12 shows a perspective view of the frame 110 with the channel flaps 126 and 128 folded and glued into position over the first and third panels 112 and 116, and the support flaps 130 and 132 folded into place over the second and fourth panels 114 and 118. FIG. 12 shows the guide channel 158 formed by the channel flaps 126, as well as the guide slot 158. FIG. 12 also shows the overlap of the support flaps 130 and 132.

Figure 13:
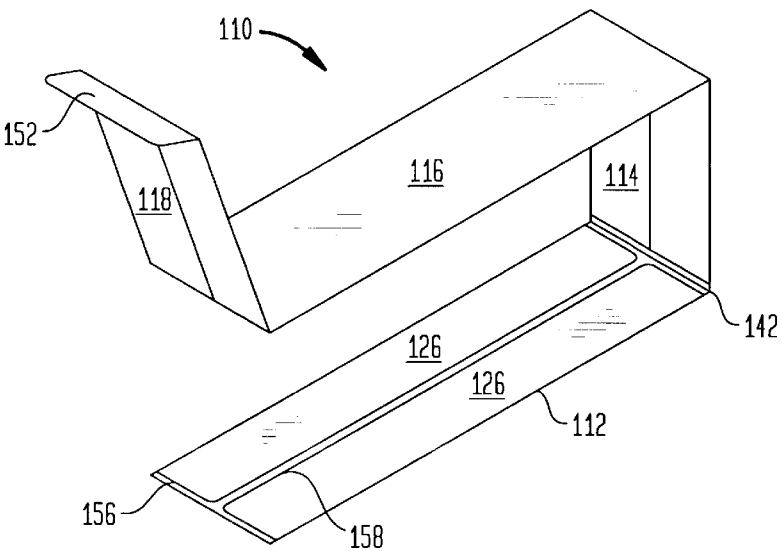
FIG. 13 shows a perspective view of the frame shown in FIG. 12, folded into position to receive a chassis, such as the one shown in FIG. 6.

FIG. 13 shows a perspective view of the frame 110 shown in FIG. 12, folded to receive the chassis 70. Specifically, the frame has been folded such that the first and third panels 112 and 116 are substantially parallel to each other, and substantially perpendicular to the second panel 114. Panel 118 has been folded out of the way to allow the insertion of the chassis 70 into the guide channels 156.

Figure 14:
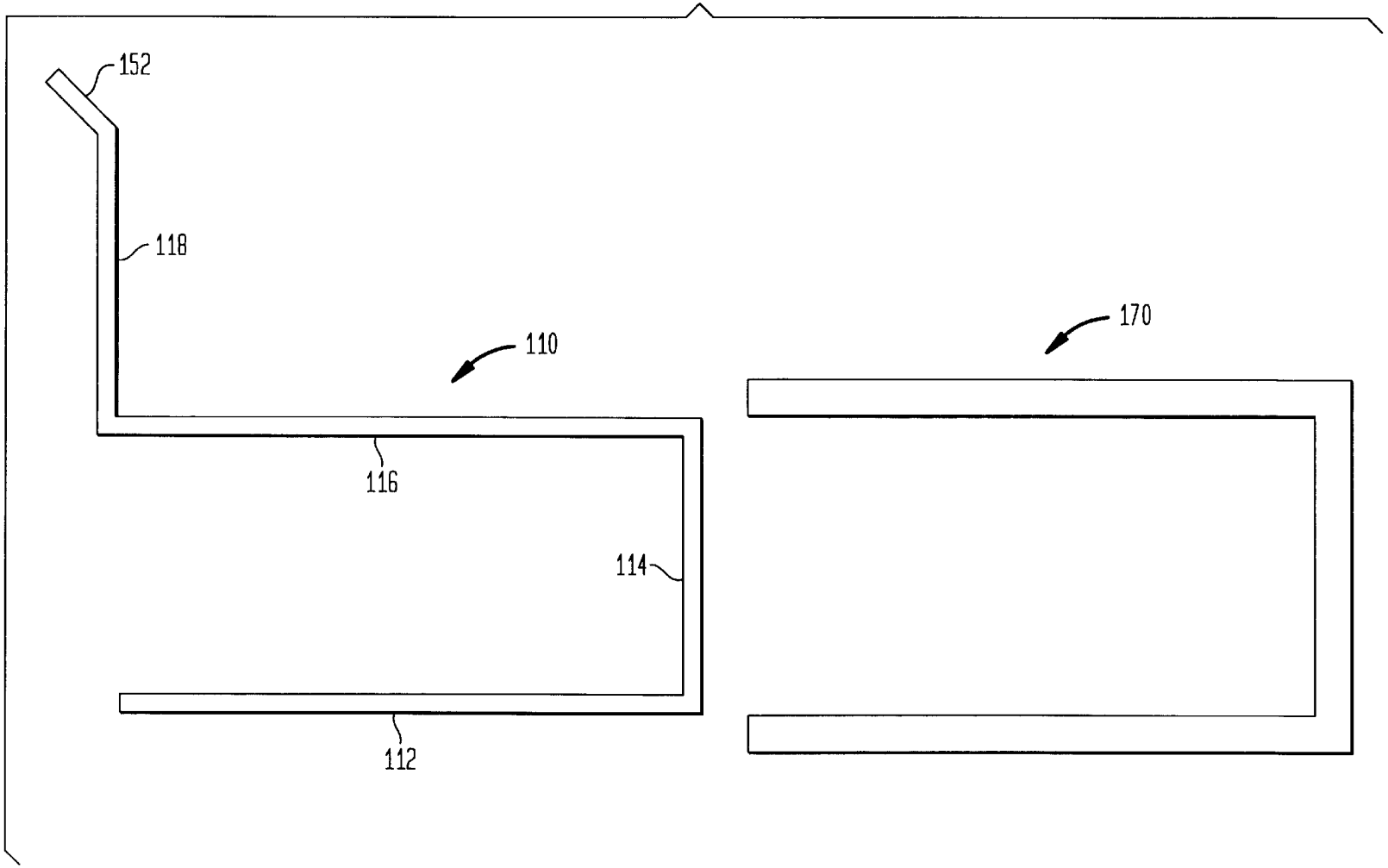
FIG. 14 shows a diagram of a jig that can be used for holding the frame shown in FIG. 13 to receive a chassis, such as the one shown in FIG. 6.
Figure 15:
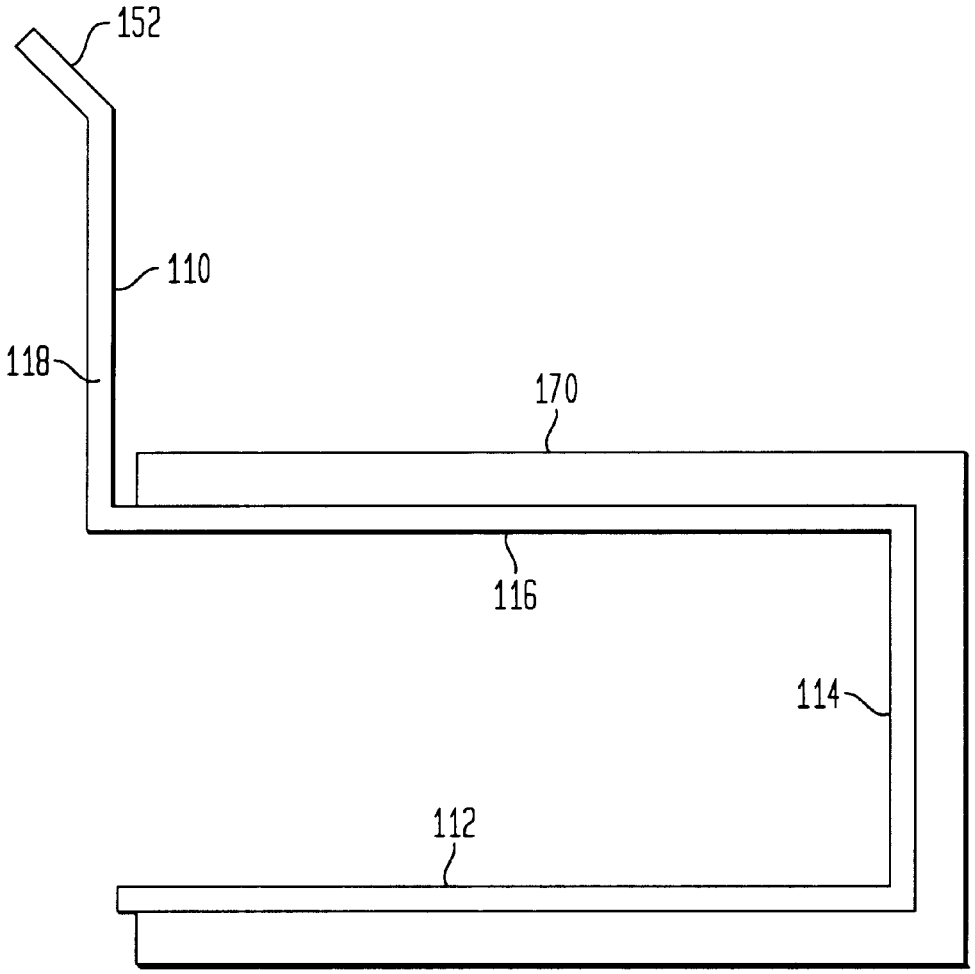
FIG. 15 shows a diagram of the jig shown in FIG. 14 with the chassis seated inside the jig.

FIG. 14 shows a diagram of a jig 170 that is used to hold the frame 110 to receive the chassis 70. The jig 170 provides stability to the frame 110 to facilitate the process of sliding the chassis 70 into the frame 110. FIG. 15 shows the jig 170 of FIG. 14 with the frame 110 loaded in position. The jig 170 may be simply a cardboard box that is dimensioned to closely receive the frame 110.

Figure 16:
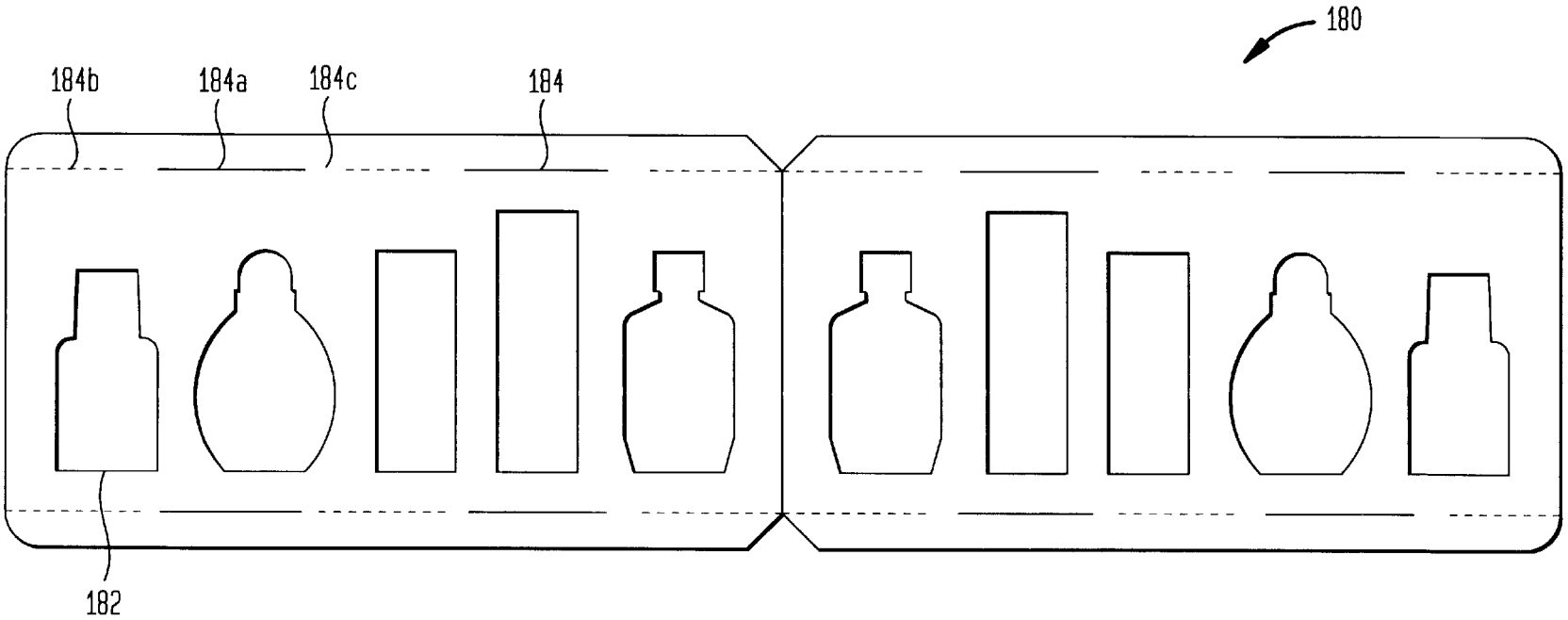
FIG. 16 shows an elevation view of an unfolded chassis according to a further aspect of the invention.

As mentioned above, the compartments may be of any of a number of different shapes and sizes. FIG. 16 shows an elevation view of an unfolded chassis 180 in which the compartments 182 are each of different shapes. FIG. 16 also illustrates a technique for fabricating the flange score lines 184. According to this technique, the flange score lines 184 include sections 184*a*, shown as solid lines, where a cut is made entirely through the plastic material. The flange score lines 184 further includes sections 184*b*, shown using broken lines, where a score line is made by partially cutting through the plastic material. Finally, the flange score lines 184 include sections 184*c*, shown as blank spaces, where there is neither a cut nor a score. These areas of the flange score lines 184*c* are called "stands," and are provided as a transition between the cut sections 184*a* and the scored sections 184*b*. The use of cut-through sections 184*a*, scored sections 184*b*, and stands 184*c* provides an easy to make, clean fold.

Figure 17:
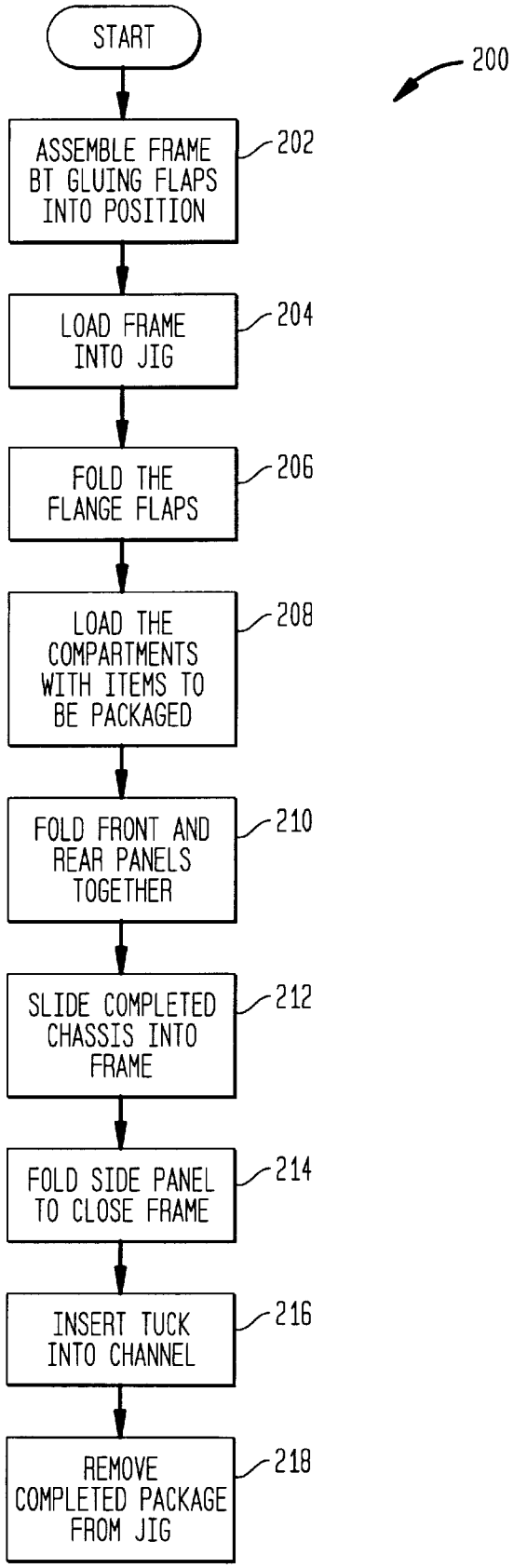
FIG. 17 shows a flowchart of a method according to a further aspect of the present invention for fabricating a package.

FIG. 17 shows a flowchart of a method 200 according to a further aspect of the invention for assembling a package. In step 202, a frame is assembled by gluing the channel flaps and support flaps into position against the frame panels. In step 204, the assembled frame is folded and loaded into a jig 204. In step 206, the flange flaps are folded on the chassis. This can be accomplished by using a folding device such as the one shown in FIGS. 8–10. In step 208, the cavities of the chassis are loaded with the items to be packaged. In step 210, the front and rear panels of the chassis are folded together. In step 212, the completed chassis is slid into the frame held in the jig. In step 214, the frame is closed over the chassis by folding the final panel into place. In step 216, the tuck is fitted into the guide channel, and in step 218, the completed package is removed from the jig.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A package for holding an item, comprising:

a chassis having a compartment for holding the item, the chassis including a front panel and a rear panel, the compartment being formed by a portion of the front panel and a corresponding portion of the rear panel, the chassis further including first and second flanges at opposite sides of the chassis, each flange being formed by front and rear flange flaps extending from the front and rear chassis panels; and a frame for holding the chassis, the frame including a series of flat panels fitting around the chassis, the series of frame panels including a first frame panel having a first guide channel and guide slot and a second panel having a second guide channel and guide slot, the first and second flanges and the first and second frame panels being positioned wit respect to each other such that the chassis may be loaded into the frame by sliding the first flange down the length of the first guide channel and guide slot and sliding the second flange clown the length of the second guide channel and guide slot.

2. The package of claim 1, wherein the compartment is spaced from the frame such that a visual impression is created that an item packaged in the compartment is floating within the frame.

3. The package of claim 2, wherein the chassis is fabricated from a transparent material.

4. The package of claim 2, wherein the chassis is fabricated from a translucent material.

5. The package of claim 1, wherein the compartment is fabricated from a cavity molded into the front panel and a corresponding portion of the rear panel.

6. The package of claim 1, wherein the compartment is fabricated from a cavity molded into the rear panel and a corresponding portion of the front panel.

7. The package of claim 1, wherein the compartment is fabricated from a cavity molded into the front panel and a corresponding cavity molded into the rear panel.

8. The package of claim 1, wherein the front and rear panels are fabricated from a single sheet of material.

9. The package of claim 8, wherein the front and rear panels are separated from each other by a score line, and are folded at the score line such that the front and rear panels line up with each other.

10. The package of claim 1, wherein each of the flange flaps include a tapered portion, the tapered portions of the flange flaps forming a pointed wedge.

11. The package of claim 8, wherein the flange flaps are separated from the front and rear panels by flange score lines.

12. The package of claim 1, wherein the frame folds around the chassis.

13. The package of claim 1, wherein the frame is closed by folding a panel over the chassis, the panel having a tuck extending therefrom that is tucked into the guide channel.

14. The package of claim 13, wherein the tuck is held in the guide channel by friction.

15. The package of claim 13, further including a locking arrangement for holding the tuck in the guide channel.

16. The package of claim 1, wherein the guide channel is formed by a pair of channel flaps that are folded over a frame panel.

17. The package of claim 16, wherein guide slot is formed by a gap between the folded channel flaps.

18. The package of claim 16, wherein the channel flaps are attached to the frame panel by glue that is applied to an outer portion of the frame panel.

19. The package of claim 1, wherein the frame includes a panel having support flaps that fold over the panel to provide reinforcement to the panel at an edge of the chassis.

20. The package of claim 1, wherein the frame is formed from a single sheet of material.

21. The package of claim 1, wherein the chassis is substantially rectangular, wherein the frame includes a series of four panels that are foldable into a rectangle fitting around the chassis, and wherein the frame is foldable into a configuration providing access to the first and second guide channels and guide slots, allowing the chassis to be installed into the frame by sliding the first and second flanges into the first and second guide channels and guide slots.

* * * * *

UNITED STATES PATENT AND TRADEMARK OFFICE

CERTIFICATE OF CORRECTION

PATENT NO. : 6,581,777 B2
DATED : June 24, 2003
INVENTOR(S) : Thibault

It is certified that error appears in the above-identified patent and that said Letters Patent is hereby corrected as shown below:

Drawings,
Sheet 13, Fig. 17, step 202 reading "ASSEMBLE FRAME BT GLUING FLAPS INTO POSITION" should read -- ASSEMBLE FRAME BY GLUING FLAPS INTO POSITION --.

Column 2,
Line 3, after "evaluation view" and before "the folding device", insert -- of --.

Column 3,
Line 2, the drawing reference numeral "14" should read -- 16 --.
Lines 14 and 27, the drawing reference numeral "20" each occurrence, should read -- 14 --.
Lines 36 and 40, the drawing reference numeral "32", each occurrence, should read -- 36 --.
Line 49, "outer" should read -- inner --.
Line 51, the drawing reference numeral "54", second occurrence, should read -- 52 --.

Column 5,
Line 12, the drawing reference numeral "78a" should read -- 72a --.
Line 12, the drawing reference numeral "78b" should read -- 72b --.
Line 31, the drawing reference numeral "78a" should read -- 80a --.
Line 32, the drawing reference numeral "78b" should read -- 80b --.
Line 32, after "interior" delete "20".

Column 7,
Line 54, the drawing reference numeral "158" should read -- 156 --.

Column 8,
Line 57, "flat" should read -- frame --.
Line 62, "wit" should read -- with --.
Line 66, "clown" should read -- down --.

UNITED STATES PATENT AND TRADEMARK OFFICE

CERTIFICATE OF CORRECTION

PATENT NO. : 6,581,777 B2
DATED : June 24, 2003
INVENTOR(S) : Thibault

It is certified that error appears in the above-identified patent and that said Letters Patent is hereby corrected as shown below:

Column 10,
Line 11, after "wherein" and before "guide slot", insert -- a --.

Signed and Sealed this

Twenty-third Day of March, 2004

JON W. DUDAS
*Acting Director of the United States Patent and Trademark Office*